United States Patent [19]

Sasaki et al.

[11] 4,039,417

[45] Aug. 2, 1977

[54] ELECTRODE ASSEMBLY FOR USE IN CATHODIC PROTECTION

[75] Inventors: Yoshinori Sasaki; Isao Yokoyama; Motohiko Makino; Syun Awaji, all of Nikaho; Kaneo Hosoya, Honjyo, all of Japan

[73] Assignee: TDK Electronics Company, Limited, Tokyo, Japan

[21] Appl. No.: 638,277

[22] Filed: Dec. 5, 1975

[30] Foreign Application Priority Data

Feb. 18, 1975 Japan ..... 50-22212[U]

[51] Int. Cl.[2] ..... C23F 13/00

[52] U.S. Cl. ..... 204/196; 204/286; 204/291; 204/297 R; 204/279

[58] Field of Search ..... 204/147, 148, 196, 197, 204/286, 291, 297 R

[56] References Cited

U.S. PATENT DOCUMENTS

| | | | |
|---|---|---|---|
| 2,949,417 | 8/1960 | Preiser et al. | 204/196 |
| 3,135,677 | 6/1964 | Fischer | 204/196 |
| 3,619,381 | 11/1971 | Fitterer | 204/195 S |
| 3,711,397 | 1/1973 | Martinsons | 204/291 |
| 3,940,327 | 2/1976 | Wagner et al. | 204/195 S |

OTHER PUBLICATIONS

Haikh's Chemical Dictionary, 4th ed., p. 264.

*Primary Examiner*—T. Tung

*Attorney, Agent, or Firm*—Burgess, Ryan and Wayne

[57] ABSTRACT

A cathodic protection electrode is mounted in an iron bushing by way of a ring of alumina or forsterite, the bushing being mounted in a glass-lined metallic vessel, such as a water heater. The electrode comprises a solid solution of $MFe_2O_4$ (wherein M is at least one metal selected from the group consisting of Mn, Ni, Co, Mg, Cu and Zn) of 0.15 to 87.1 mol%, and $Fe_3O_4$ of 99.85 to 12.9 mol%.

5 Claims, 3 Drawing Figures

ELECTRODE ASSEMBLY FOR USE IN CATHODIC PROTECTION

BACKGROUND OF THE INVENTION

The present invention relates to an electrode assembly for use in cathodic protection of glass-lined metallic vessels, such as water heaters.

Figure 1:
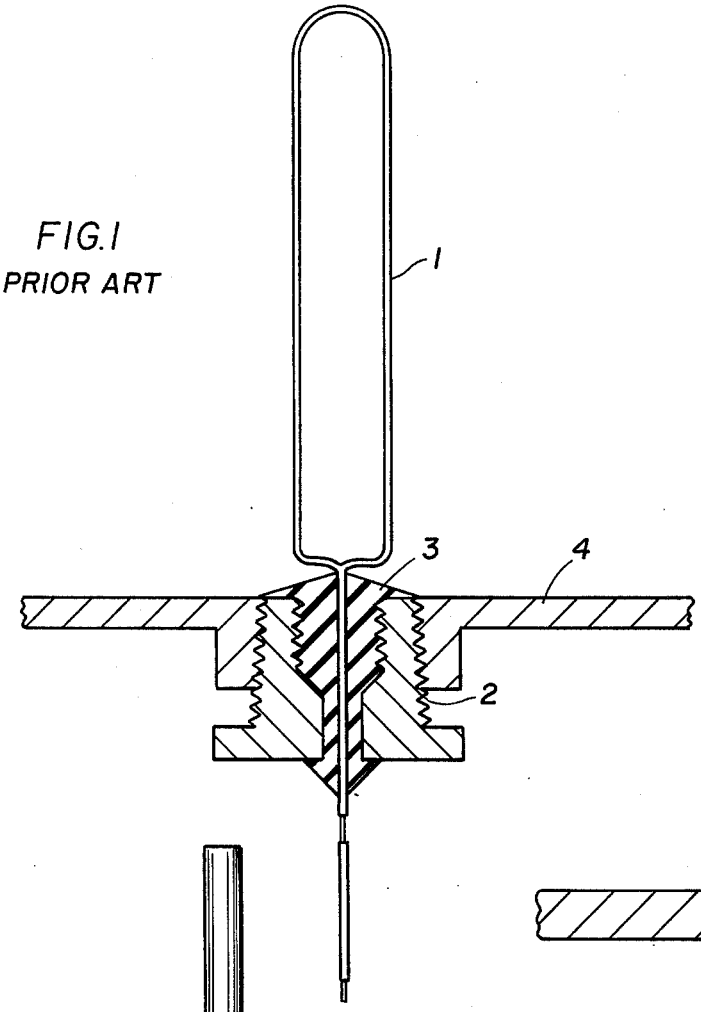
FIG. 1 PRIOR ART

In a known electrode for use in the cathodic protection of a glass-lined metallic vessel such as a water heater, a platinum-coated titanium wire is used as an anode. This is illustrated in FIG. 1 of the accompanying drawings, wherein the platinum-coated titanium wire 1 is held in the central aperture of a bushing 2 by a filling 3 of silicone rubber. The bushing 2 is mounted in a wall of the vessel 4. In this arrangement, the silicone rubber filling 3 deteriorates due to its immersion in cold or hot water for a long period of time, resulting in leakage of water from the vessel.

Figure 2:
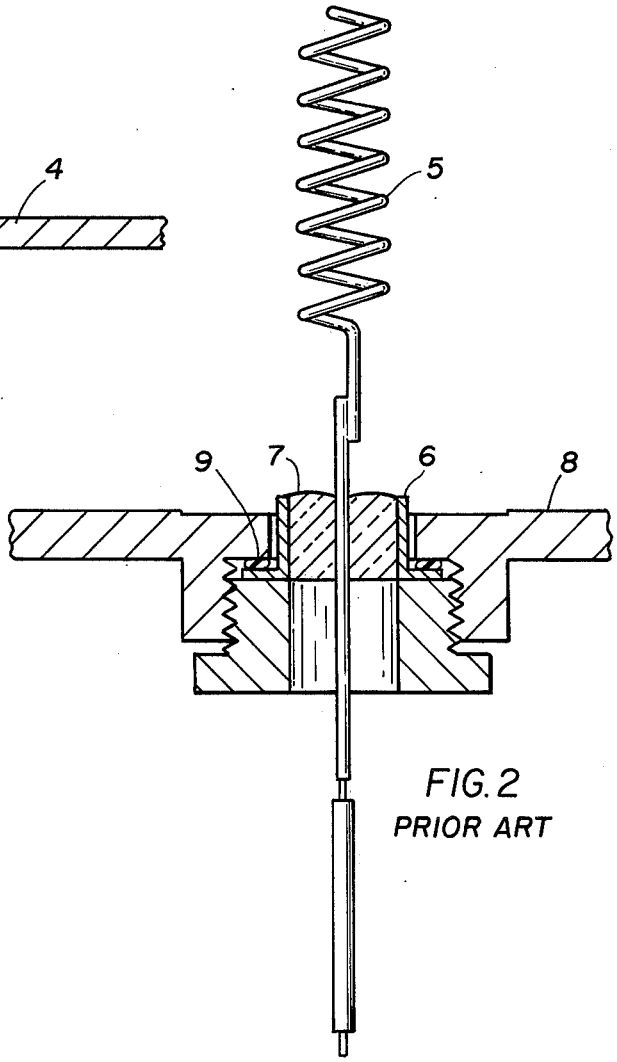
FIG. 2 PRIOR ART

FIG. 2, illustrates another known electrode arrangement, in which the platinum-coated titanium wire 5 is held in a bushing 6 by a glass filling 7 instead of silicone rubber as in FIG. 1. The bushing 6 is threaded into a wall of the glass-lined vessel 8. An O-shaped ring 9 is inserted between the bushing 6 and the wall of the vessel 8. In this arrangement, the adhesion between the platinum-coated wire 5 and the glass filling 7 is poor, and the glass 7 is apt to break due to the differences of the thermal coefficients of expansion of the wire 5, the bushing 6 and the glass 7.

Furthermore, the conventional electrodes as shown in FIGS. 1 and 2, have the defect that the platinum-coated titanium wire has low resistance for ripple currents.

It is an object of the present invention to provide an electrode assembly for use in cathodic protection which has excellent corrosion resistance, and which can withstand alternating thermal stress for a long period of time.

SUMMARY OF THE INVENTION

Briefly stated, in accordance with the present invention, this object is achieved by providing a ferrite sintered electrode that is a solid solution of $MFe_2O_4$ (wherein M is at least one metal selected from the group consisting of Mn, Ni, Co, Mg, Cu and Zn) and $Fe_3O_4$. This electrode is held in a ring of alumina or forsterite, the ring being held in an iron bushing which may, for example, be threaded in the wall of the glass-lined tank.

The ferrite sintered body may be made by heating a mixture of iron oxide and metal oxide MO (M is Mn, Ni, Co, Mg, Cu or Zn) to a temperature of 700° to 1000° C for one to fifteen hours, then cooling the mixture and pulverizing it. The resultant powder is formed into a shaped body and then heated to a temperature of from 1100° to 1450° C, from 1 to 4 hours.

BRIEF FIGURE DESCRIPTION

Figure 3:
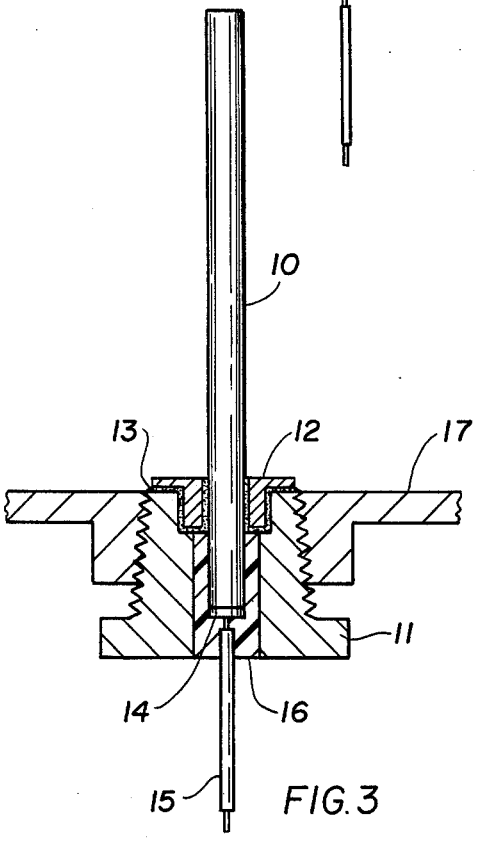

In order that the inventon will be more clearly understood, it will now be explained in greater detail with reference to the accompanying drawings, wherein:

FIG. 1 is a partially cross-sectional view of one form of known cathodic protection system;

FIG. 2 is a partially cross-sectional view of another form of known cathodic protection system; and FIG. 3 is a partially cross-sectional view of a cathodic protection system for glass-lined vessel, in accordance with the invention. DETAILED DESCRIPTION Referring now to FIG. 3, an electrode 10 for use in cathodic protection in accordance with the invention is a ferrite sintered body. The electrode 10 is inserted in an iron bushing 11, with a ring of alumina or forsterite 12 between the electrode 10 and the bushing 11. The clearances between the electrode 10 and the ring 12 and between the bushing 11 and the ring 12, are filled with glass 13. A terminal block 14 is fixed to the external end of electrode 10 and a lead wire 15 is connected to the terminal block 14. The gap between the electrode 10 and the bushing 11 is filled with an insulating resin 16. The bushing 11 holding the electrode 10 is mounted, for example by threading, in the wall of the glass-lined metallic vessel 17.

The electrode, i.e. the ferrite sintered body 10 is a solid solution of $MFe_2O_4$ (wherein M is at least one metal selected from the group consisting of Mn, Ni, Co Mg, Cu and Zn) of 0.15 to 87.1 mol% and $Fe_3O_4$ of 99.85 to 12.9 mol%, preferably a solid solution of $MFe_2O_4$ of 15.7 to 87.1 mol% and $Fe_3O_y$ of 84.3 to 12.9 mol%.

The ferrite sintered body 10 may be prepared by heating a mixture of iron oxide $Fe_2O_3$ of 99.9 to 55 mol% and metal oxide MO of 0.1 to 45 mol%, wherein M is at least one metal selected from the group consisting of Mn, Ni, Co, Mg, Cu and Zn, at a temperature of 700° to 1000° C for 1 to 15 hours in an atmosphere of air or carbon dioxide, or in an atmosphere of nitrogen containing up to 10% by volume of hydrogen. The heated mixture is then cooled and pulverized and the resultant fine powder is then formed into a shaped body. The shaped body is then heated at a temperature of 1100° to 1450° C in an atmosphere of nitrogen or carbon dioxide containing up to 20° by volume of oxygen for 1 to 4 hours.

It has been found that an electrode made in accordance with the invention, as above described, provides excellent corrosion resistance, and can withstand alternating thermal stress for a considerable period of time. The electrode is not subject to deterioration, nor to breakage due to different thermal coefficients of expansion of the elements, and hence the problems of the described known electrodes have been overcome by the electrode assembly of the present invention.

While the invention has been disclosed and described with reference to a limited number of embodiments, it will be apparent that variations and modifications may be made therein, and it is intended in the following claims to cover each such variation and modification as follows within the spirit and scope of the invention.

We claim:

1. An electrode assembly for the cathodic protection of a glass-lined metallic vessel comprising a ferrite electrode, a ring of a material selected from the group consisting of alumina and forsterite supporting said electrode, and an iron bushing adapted to be mounted in a wall of said vessel, said ring being mounted in said bushing.

2. The electrode assembly of claim 1 wherein said ferrite electrode comprises a solid solution of $MFe_2O_4$, wherein M is at least one metal selected from the group consisting of Mn, Ni, Co, Ng, Cu and Zn, of 0.15 to 87.1 mol% and $Fe_3O_4$ of 99.85 to 12.9 mol%.

3. The electrode assembly of claim 2 wherein said ferrite electrode comprises a solid solution of 15.7 to 87.1 mol% $MFe_2O_4$ and 84.3 to 12.9 mol% $Fe_3O_4$.

4. The electrode assembly of claim 1 comprising a glass layer between said ring and said electrode and between said ring and said bushing.

5. The electrode assembly of claim 1 wherein said ring extends into said bushing, and a terminal is provided on the end of said electrode within said bushing for interconnection with an external lead.

* * * * *

UNITED STATES PATENT OFFICE

CERTIFICATE OF CORRECTION

Patent No. 4,039,417 Dated August 2, 1977

Inventor(s) Yoshinori Sasaki, et al

It is certified that error appears in the above-identified patent and that said Letters Patent are hereby corrected as shown below:

In the Title Page, under "OTHER PUBLICATIONS": "Haikh's" should read --Hackh's--.

Column 2, line 16: "$Fe_3O_y$" should read --$Fe_3O_4$--.

Column 2, line 56: "Ng" should read --Mg--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*